US005660349A

United States Patent [19]

Miller et al.

[11] Patent Number: 5,660,349

[45] Date of Patent: Aug. 26, 1997

[54] METHOD AND APPARATUS FOR WINDING CORELESS ROLLS

[75] Inventors: David C. Miller, Appleton; Richard J. Vigneau; Gerald W. Buxton, both of Green Bay, all of Wis.

[73] Assignee: Paper Converting Machine Company, Green Bay, Wis.

[21] Appl. No.: 373,179

[22] Filed: Jan. 23, 1995

Related U.S. Application Data

[63] Continuation-in-part of Ser. No. 243,134, May 16, 1994, abandoned.

[51] Int. Cl.[6] ..... B65H 35/08; B65H 19/28; B65H 23/00

[52] U.S. Cl. ..... 242/526.1; 242/527; 242/532.2; 242/533.4; 242/548

[58] Field of Search ..... 242/526.1, 527, 242/527.1, 531.1, 533.4, 542, 542.2, 548, 532.2

[56] References Cited

U.S. PATENT DOCUMENTS

| | | | |
|---|---|---|---|
| Re. 28,353 | 3/1975 | Nystrand et al. | 242/56 |
| 1,681,046 | 8/1928 | Marresford | 242/542.2 |
| 2,769,600 | 11/1956 | Kwitek et al. | 242/56 |
| 2,870,840 | 1/1959 | Kwitek | 164/68 |
| 3,066,882 | 12/1962 | Havens et al. | 242/542.2 |
| 3,116,890 | 1/1964 | Nystrand | 242/64 |
| 3,266,744 | 8/1966 | Volm et al. | 242/64 |
| 3,697,010 | 10/1972 | Nystrand | 242/56 |
| 3,814,342 | 6/1974 | Fujiwara | 242/533.4 X |
| 4,245,796 | 1/1981 | Eglinton | 242/542.2 |
| 4,487,378 | 12/1984 | Kobayashi | 242/160.1 |
| 4,529,141 | 7/1985 | McClenathan | 242/527.1 |
| 4,611,638 | 9/1986 | Matumura | 242/532.2 X |
| 5,150,848 | 9/1992 | Consani | 242/542.2 |

OTHER PUBLICATIONS

Drawing 059887-17-14-00 Dated 22 May 1987 of Paper Converting Machine Company.

*Primary Examiner*—John Q. Nguyen

*Attorney, Agent, or Firm*—Tilton, Fallon, Lungmus & Chestnut

[57] ABSTRACT

A method and apparatus for transferring a web to a mandrel to form a coreless, convolutely wound roll which includes an enveloping roller, first and second mandrels, a transfer roller and a cutoff mechanism in the path of travel of a web to be wound, advancing a web in partial enveloping relation with the enveloping roller and toward the first mandrel, moving the second mandrel to a position adjacent the web, orienting the enveloping roller and transfer roller to positions defining a pocket with the second mandrel in the pocket to define a nip between the second mandrel and enveloping roller, rotating the transfer roller in a direction opposite to the direction of advance of the web, and severing the web to provide a leading edge portion.

35 Claims, 7 Drawing Sheets

METHOD AND APPARATUS FOR WINDING CORELESS ROLLS

This application is a continuation-in-part of application Ser. No. 08/243,134 filed May 16, 1994 abandoned.

BACKGROUND AND SUMMARY OF INVENTION

This invention relates to a method and apparatus for winding coreless rolls or logs and, more particularly, relating to the transfer of a web to a winding mandrel for developing a coreless log. A "log" has the same diameter as the commercial sized roll of bathroom tissue or kitchen toweling but is much longer. Current practice is to transversely cut the log into rolls, viz., in the U.S. 4½" long for bathroom tissue and 11" long for kitchen toweling while in Europe the counterpart lengths are 140 mm and 280 mm, respectively.

A few coreless wound products have been in existence for the last 10 or 15 years. These can be separated into three categories. First, there is the large diameter tissue and towel rolls made to dispense from the center. Second, there are tissue rolls with very small "core" diameters made to dispense either from special, barbed shafts or without the use of any dispensing shaft but rather using a cradle. The use of these two categories has been generally confined to Europe. Third, there is a category which is frequently discussed but has never caught on. Exemplary of this is a bathroom tissue roll for a standard home dispenser but without the core. One of the obstacles in developing such a product is the difficulty in starting the wind.

The invention contemplates winding a web in convolute fashion on a "bare" mandrel by using a novel arrangement of an enveloping roller, means for severing a web equipped with transverse perforations and means for directing the leading edge portion of the severed web into a nip between the enveloping roller and a "new" mandrel so as to obtain a "glue-less" transfer.

Representative of the prior art is co-owned U.S. Pat. No. 3,697,010 and machines made according to the patent teachings were not made for nor suited for cross perforated tissue and/or kitchen toweling. A prior art commercial machine made by the assignor hereof Paper Converting Machine Company, of Green Bay, Wis. and sold in Europe produced coreless rolls but not with commercially-acceptable perforations. The machine used orbiting mandrels with a stationary anvil positioned within the mandrel orbit. A rotating enveloping roller moved through the web path to move the web into partial wrapping engagement with the mandrel next to be wound—this from the upstream side of the mandrel. A second rotating "cutoff" roller containing a protruding knife and an air jet moved against the web downstream of the mandrel to complete the wrap. The cyclic impact of the protruding knife caused the web to pulsate and the normal bonds between adjacent, aligned perforations (viz., the uncut web) were unable to avoid rupture due to this pulsation and prior to knife engagement with the anvil. As a consequence, commercial bathroom and toweling with bonds of the order of ½–1 mm could not be reliably produced—because the pulsation caused the web to rupture prematurely and thus prevent the achievement of the mandatory exact "count".

This drawback has been solved by the instant invention where, after the enveloping roller has achieved partial wrap of the "new" mandrel, a steady, pulsation-less force applying means is provided in the place of the cutoff roller for a web having longitudinally spaced lines of perforation with the perforations in each line being separated by bonds of the order of ½–1 mm. This achieves the goal of having the web severed along a predetermined line of perforation to achieve the exact count.

Other objects and advantages of the invention may be seen in the details of construction and operation set forth in the ensuing specification.

BRIEF DESCRIPTION OF DRAWING

The invention is described in conjunction with the accompanying drawing, in which.

DETAILED DESCRIPTION

Figure 2:
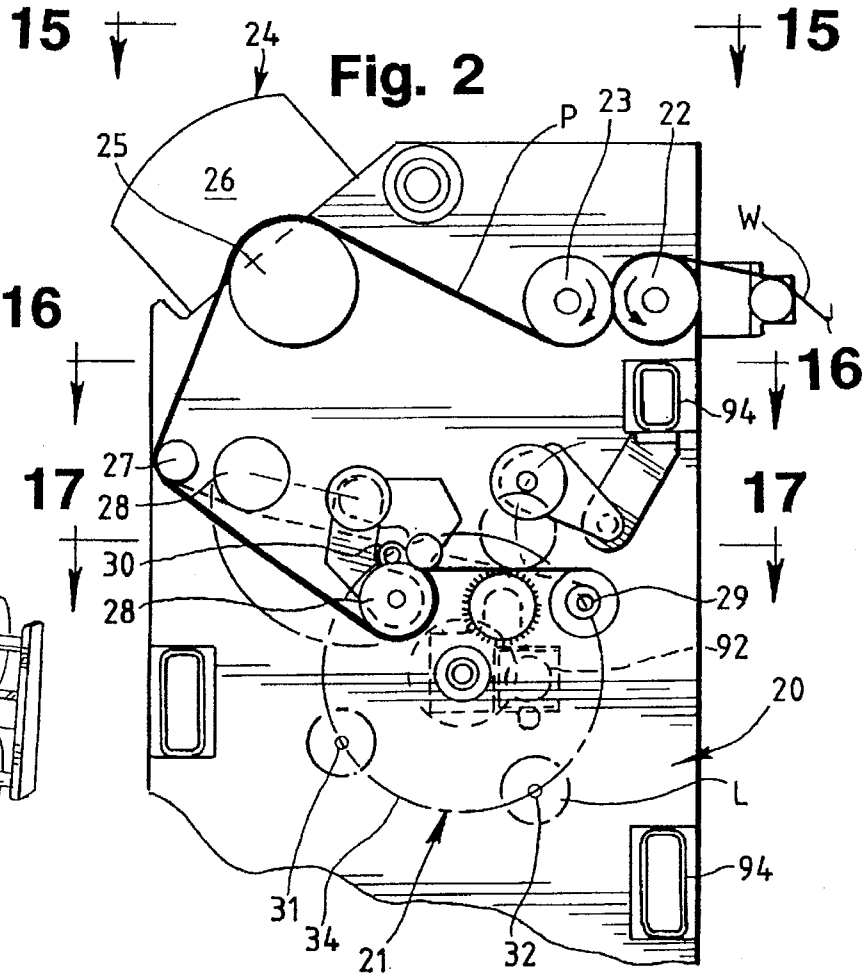
FIG. 2 is a side elevational view of the winder seen in FIG. 1.
Figure 1:
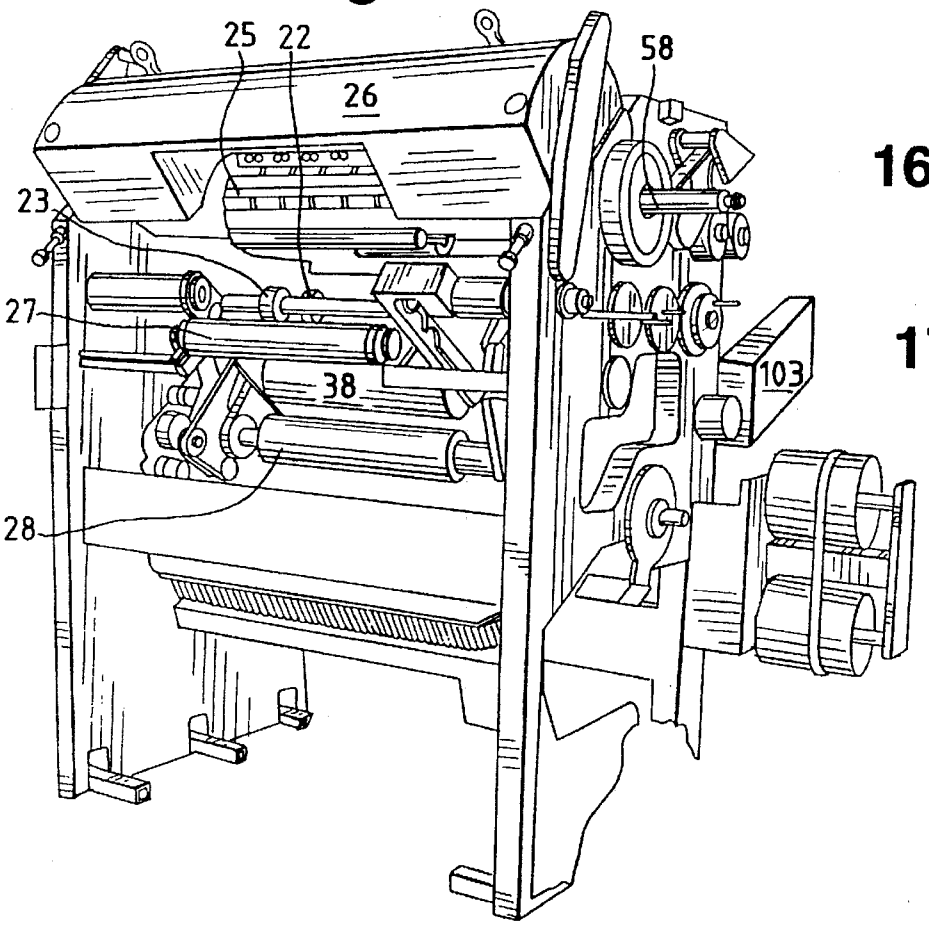
FIG. 1 is a perspective view of a winder embodying teachings of this invention.

Referring first to FIGS. 1 and 2 which show the overall winder, the symbol 20 generally designates a frame for a rewinder which has a multi-station rotatable turret generally designated 21. For generally similar type winders, reference may be made to U.S. Pat. No. 3,697,010. That patent shows a "glueless" transfer to a core-equipped mandrel which utilizes different machine elements than the instant invention. However, the '010 patent is pertinent in showing a form of mandrel drive which can be employed to advantage in the practice of the instant invention. A widely employed rewinder of the "center wind" type may be seen in co-owned Pat. No. RE 28,353. Reference may be had to any of the patents described herein for additional details of construction and operation not set forth herein.

The Invention

The environmental features of the invention can be seen in FIG. 2 in somewhat schematic form. A web W (at the right) is advanced along a longitudinally extending path P by draw rollers 22, 23. The web then passes through a perforator generally designated 24 including blade roller 25 and knife bar 26. Illustrative of a widely used perforator is that of co-owned U.S. Pat. No. 2,870,840. The web then passes around an idler 27 and around an enveloping roller 28—now being directed into the turret 21 of the center winder. This type of winder has a decreasing mandrel speed characteristic to compensate for log build up—as contrasted to a surface winder.

As illustrated, the turret 21 has four mandrels 29, 30, 31 and 32. It will be appreciated that a greater or lesser number of mandrels (or stations) may be employed, with the minimum number being two. Such turret constructions are well known—see co-owned, expired U.S. Pat. No. 2,769,600.

Figure 3:
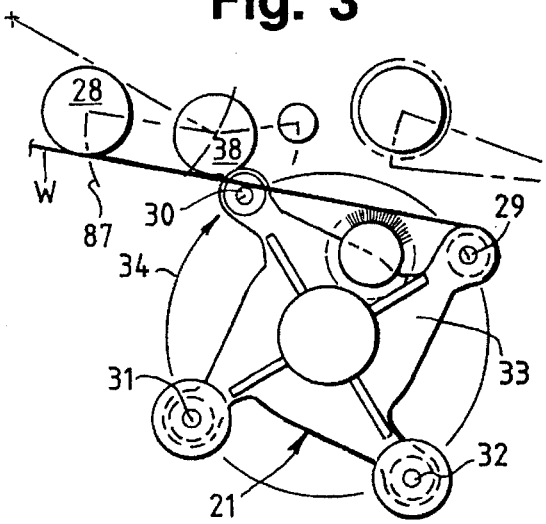
FIG. 3 is a fragmentary schematic view of an arrangement of rollers employed in the practice of the instant invention and showing the disposition of the rollers during a winding cycle.

The turret 21 is generally spider-like, being equipped with arms as at 33 in FIG. 3 for carrying the various mandrels. In FIG. 3, the mandrels 32, 31 each have a completely wound log L mounted thereon and are in position for stripping the log from the mandrel—in whichever location is preferred. Mandrel stripping can be seen in greater detail in co-owned application Ser. No. 08/139,545 filed Oct. 20, 1993. Before going into the structural details of the turret and associated elements, we first describe the sequence of steps performed during cutoff and transfer. For this, initial reference is made to FIGS. 3–6 which show successive positions of the various machine elements as cutoff is approached.

FIG. 3 Showing

The first mandrel which has been previously designated 29 in FIG. 2 is seen in FIG. 3 as the mandrel being wound with the web W. A second mandrel is designated 30 and is seen approaching a position of contact with the web W as the turret 21 rotates clockwise—as designated by the arrow 34. The mandrel 30 is now being accelerated to web speed. The enveloping roller 28 has been pivoted to its farthest distance away from the mandrel 30—compare the heavy solid line web path in FIG. 2.

FIG. 4 Showing

Here it will be noted that the enveloping roller 28 has started to pivot counterclockwise (see arrow 35) from its position in FIG. 3 to become partially enveloped by the web and also develop a partial enveloping relation of the web with the mandrel 30. The web W, however is still being wound on mandrel 29. Because the winding of the log is nearing completion, a pivotally mounted cutoff roller 37 starts to move toward an anvil roller 36. So also does the optional backing roller 38 move—see the direction arrow 39 and compare with the roller 38 location in FIG. 3. On short web lengths, viz., small rolls, it is possible to have the mandrel 30 accelerated to speed prior to reaching the FIG. 5 position, so that the backing roller 38, if present, need not move—or not move very far. As will be brought out hereinafter, certain preferred embodiments do not use the backing roller 38.

FIG. 5 Showing

Figure 4:
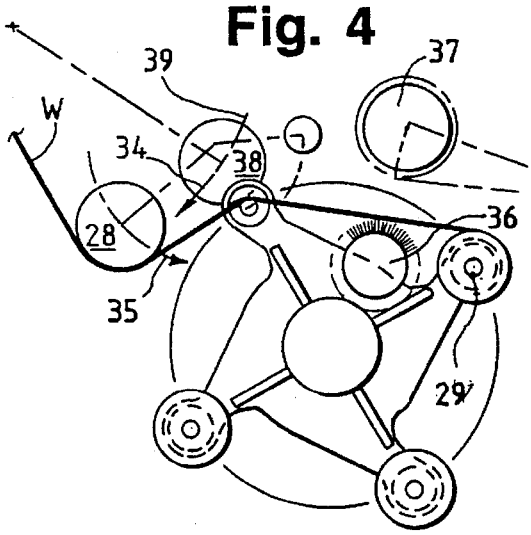
FIG. 4 is a view similar to FIG. 3 but showing the disposition of rollers somewhat later in the winding cycle.
Figure 5:
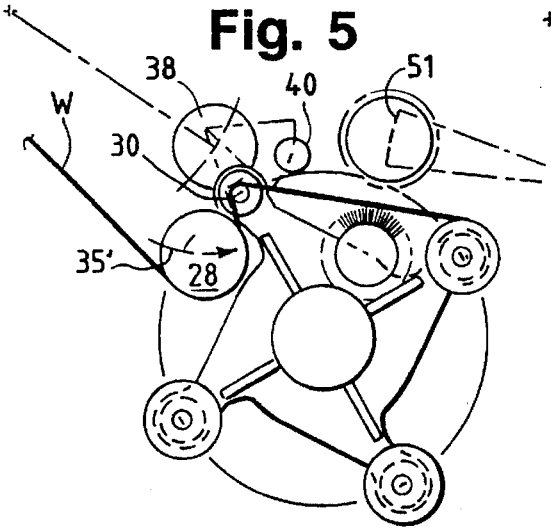
FIG. 5 is a view similar to FIG. 4 but later in the winding cycle.

Here the mandrel 30 is seen to be substantially wrapped by the web W because the enveloping roller 28 has moved further counterclockwise from its position in FIG. 4—see the arrow 35'. The backing roller 38 has also moved slightly so as to press the web W on the mandrel 30. Also seen in FIG. 5 is the downward movement of the transfer roller 40. The roller 40 cooperates with the rollers 28 and 38 and the mandrel 30 in effecting transfer.

FIG. 6 Showing

Figure 6:
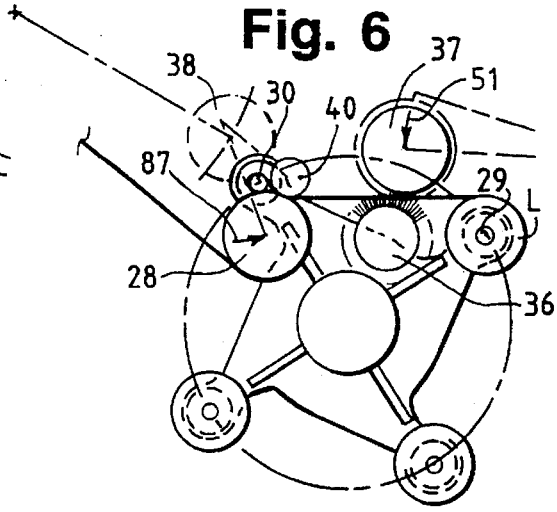
FIG. 6 is a view similar to FIGS. 3–5 and later in the winding cycle and just prior to cutoff and transfer.

The situation just before cutoff and transfer is illustrated in FIG. 6 where a log L is almost completely wound on the mandrel 29. The mandrel 30 is seen to be generally confined between the enveloping roller 28 and the transfer roller 40, the backing roller 38 being omitted here as in the preferred embodiment seen in the larger scale views of FIGS. 7–10. These show the successive positions of machine elements during cutoff and transfer.

FIG. 7 Showing

Figure 7:
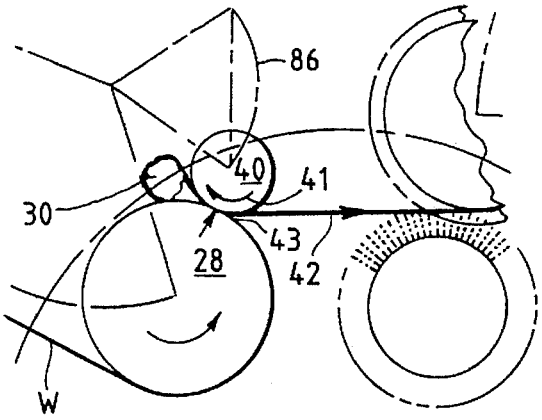
FIG. 7 is an enlarged fragmentary view similar to what is seen in FIGS. 3–6 but showing the arrangement of rollers just prior to cutoff and transfer.
Figure 14:
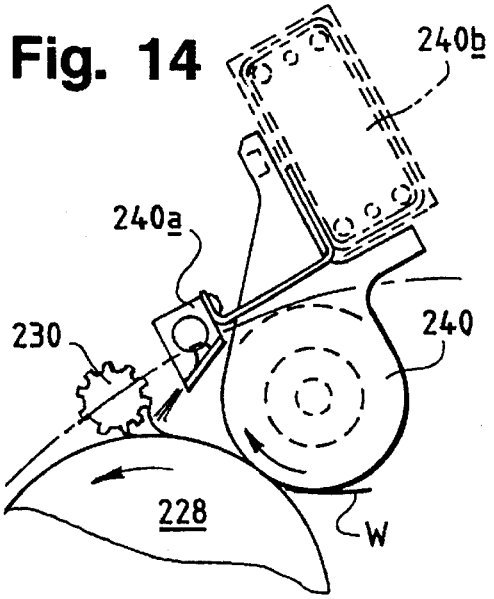
FIG. 14 is a view similar to FIG. 11 but showing a modified mandrel during web transfer and utilizing an air knife assist.

In FIG. 7, the web W is substantially wrapped or enveloped about the enveloping roller 28 and also substantially envelops the mandrel 30. The form of mandrel 30 illustrated here is equipped with flutes to assist in winding and stripping. These can be seen at **30*a* in FIG. 11. The fluted or splined version of mandrel as seen in FIGS. 12 and 14** is advantageous where the mandrel diameter is so small as not to effectively accommodate vacuum passages for machines of the order of 100" in width. Normally, mandrels of about a 1 to 1½" (25–37 mm) diameter can accommodate the vacuum passages and ports.

The vacuum passages **30*b*** assist in effecting transfer, i.e., holding the severed web against the "new" mandrel. A suitable vacuum arrangement for mandrels can be seen in co-owned application Ser. No. 38,292 filed Mar. 29, 1993.

Figure 11:
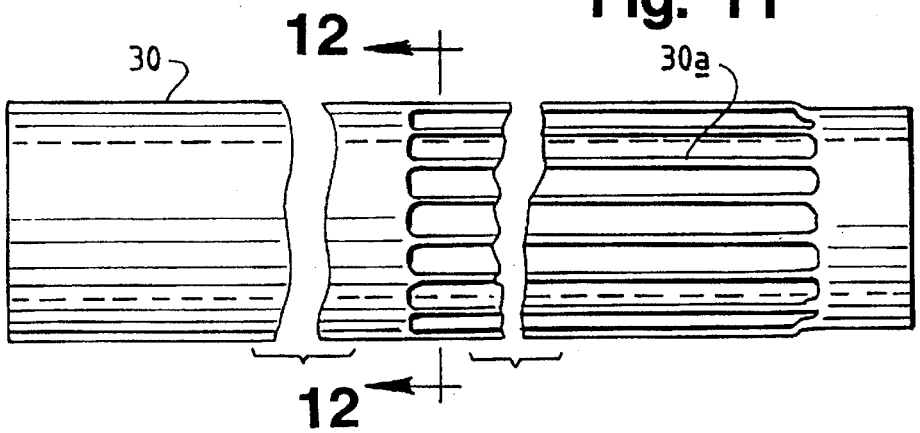
FIG. 11 is a fragmentary side elevational view of a mandrel incorporating teachings of the invention.
Figure 12:
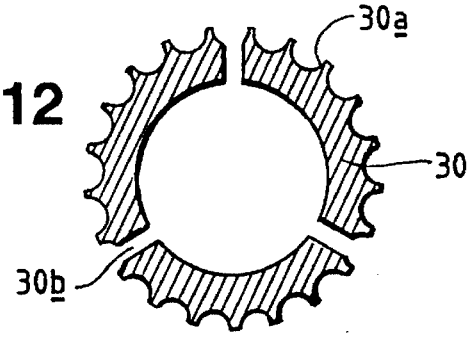
FIG. 12 is a sectional view seen along the sight line 12—12 of FIG. 11.

The fluted mandrels of FIGS. 11, 12, 14 assist in transfer by immobilizing the web on the mandrel surface. Also advantageous is the use of an air blast as at **240*a* in FIG. 14 used in conjunction with mandrel 230 and enveloping roller 228. If present, the transfer roller 240 can be carried on the bracket 240*b* which supports the air blast means 240*a*. The flutes are designated 30*b* in the larger scale showing of the mandrel 30 in FIG. 12**.

Referring again to FIG. 7, the web in proceeding further to the right is in engagement now with the transfer roller 40 which is rotating clockwise as indicated by the arrow 41. This is counter to the movement of the web as indicated by the arrow 42. At this time, the web slips relative to the transfer roller 40 to compensate for the difference in direction. There is also a slight gap between the rollers 40 and 28—indicated at 43.

FIG. 8 Showing

Figure 8:
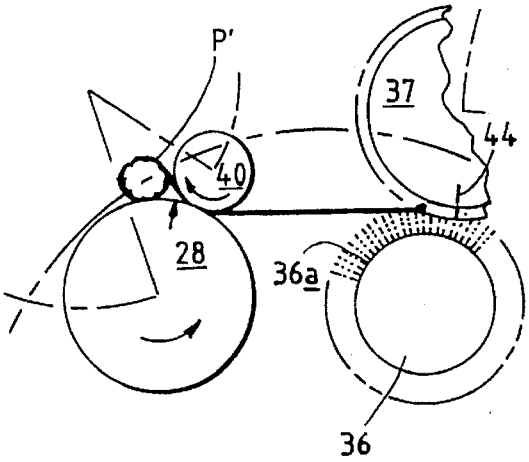
FIG. 8 is a view similar to FIG. 7 and shows the arrangement of rollers at the time of cutoff.
Figure 9:
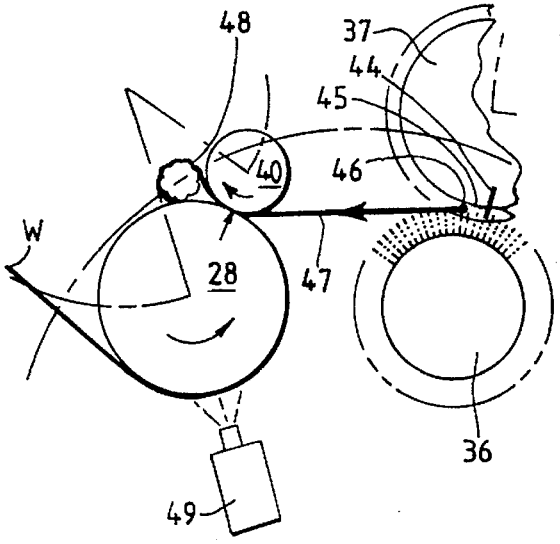
FIG. 9 is a view similar to FIGS. 7 and 8 showing the arrangement of rollers a short time after cutoff.

In FIG. 8, cutoff at a predetermined line of transverse perforation is effected by means of a knife 44 on the cutoff roller 37 engaging a brush-equipped anvil roller 36. By severing at a selected line of perforation, an exact "count", i.e., length, is achieved.

Here the roller 36 has a circumferential covering of bristles as at **36*a*. Other suitable types of anvil roll would include an anvil roll with a slot for receiving the knife 44, a roll arranged in "pinched" type relationship for cutoff, or a shear type relationship. At the time of cutoff, the transfer roller 40 has moved into contact with the surface of the enveloping roller 28 and thereby eliminates the gap 43 between the two rollers 28, 40—see FIG. 7. In this connection, it is advantageous to equip the enveloping roller 28 with a resilient covering. The configuration of rollers 28 and 40 with the web W creates a pocket P' which contains the mandrel 30**.

FIG. 9 Showing

This shows the condition of the elements shortly after cutoff. It will be noted that there is now a gap 45 between the knife 44 and the leading edge 46 of the web W. However, because of the cooperation of the enveloping roller 28 and the transfer roller 40, the web W in the leading edge portion is traveling in a reverse direction as indicated by the arrow 47. Advantageous in reducing or eliminating any loop and causing the web to conform closely to the mandrel as at 48 is the use of vacuum as previously described in conjunction with FIG. 7 and/or the application of transfer agents such as a starch or a laminating adhesive as indicated at 49. Where smaller diameter mandrels are employed, the provision of flutes also is advantageous in avoiding loop development.

FIG. 10 Showing

Here, the slack becomes more pronounced and is driven into the nip 50 between the enveloping roller 28 and the mandrel 30. This results in the web W being wound on itself or captured between plies of itself around the mandrel 30 so that there is a "glueless" transfer. Here, "glueless" is used in the sense that there is no glue or other adhesive-like material introduced between a core or, for that matter, the mandrel and the leading edge of the web. It would be undesirable to stick the web to a bare mandrel.

Ply Bonding

As pointed out previously, it is advantageous at times, however, to introduce starch or laminating adhesive as at 49 (see the bottom left of FIG. 9) so as to achieve bonding between the initially wound layers of the web on the mandrel beginning at transfer.

Figure 10:
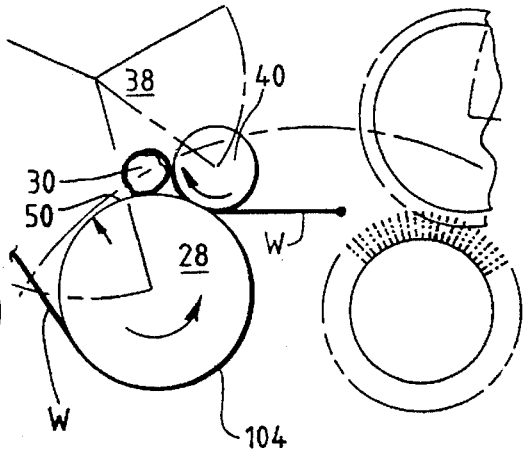
FIG. 10 is a view similar to FIGS. 7–9 but a short time after the showing in FIG. 9—as can be appreciated from the fact that there is a severed web spaced from the rollers employed for cutoff.

We have found it advantageous to employ lamination or ply bonding between the web layers as can be appreciated from a consideration of the relationship in FIG. 10. This assists in achieving the close web contact 48 FIG. 9 and directs the web W into the nip 50 between mandrel 30 and enveloping roller 28.

The invention therefore uses an enveloping transfer with a web directing means such as a nipping transfer roller rather than a cutoff bedroll with transfer fingers as was characteristic of the prior art seen in Pat. No. RE 28,353. Further, the inventive arrangement does not use an adhesive-equipped core for transfer, the invention using the enveloping nip transfer to attach the web directly to the mandrel without adhesive being applied to the receiving mandrel.

Exact Cutoff

The invention also has the ability to advance or retard the cutoff roller 37 (see also FIG. 2 as well as FIG. 8) relative to perforation to achieve exact cutoff with one sheet increments with or without variable perforation. To achieve this, we employ a cutoff separate from the enveloping roll as contrasted to the '010 patent.

The retard or advancement of the cutoff roller 37 is facilitated because of the use of the brush or bristle covering **36*a* on the cutoff roller 36. For this purpose, it is advantageous to operate the brush roller 36 at a speed different from that of the cutoff or knife roller 37. Also, the speed differential minimizes the possibility of the web wanting to stay with the brush roller 36**.

Inasmuch as the cutoff roller 37 only comes into play during cutoff and transfer, it can and does remain out of contact with the web for the large portion of the winding cycle—as can be appreciated from a consideration of FIGS. 3–6. It is only in FIG. 6 for cutoff where the cutoff roller 37 has been pivoted downwardly as indicated by the arrow 51 in FIGS. 5 and 6.

In summary, the illustrated method provides coreless winding which uses a transfer nip roller 40 next to the winding mandrel 30 and which turns in a direction opposite to that of the web and at web speed. Upon cutoff of the web by the rollers 36, 37 the transfer roller 40 nips the enveloping roller 28 and thereby pulls the severed tail 46 (see FIG. 9) onto the incoming web at the mandrel. This ability to capture the severed tail and direct it into the nip 50 of the enveloping roller creates a bond resulting in a controlled transfer with minimum wrinkling in normally high tension areas. Thereafter, both the transfer roller 40 and the enveloping roller 28 move away from the mandrel 30 to permit the mandrel 30 to index to the position previously occupied by the mandrel 29.

The transfer roller 40 is effective to apply a steady force to the web to force it toward the enveloping roll prior to the time of cutoff. Thus, it also changes the configuration of the web path.

To put this is chronological sequence, it is seen in FIG. 3 that the web path is generally linear from an upstream position in contact with the enveloping roller 28 to the downstream position in contact with the log being wound on the first mandrel 29. The movement of the enveloping roller 28 in a generally arcuate direction partway around the second mandrel forms a generally S-shaped configuration in the web path about the enveloping roller 28 and the second mandrel 30 while the web is being wound on the first mandrel 29. In other words, the web partially wraps the enveloping roller 28 upstream of the second mandrel 30 and with the enveloping roller and second mandrel forming a nip, the web downstream of the second mandrel having a generally linear configuration between the second mandrel and the first mandrel. Then the transfer roller 40 moves as seen in FIG. 6.

This applies a steady force to the web downstream of the second mandrel 30 to deflect the web toward the enveloping roller 28—see also FIG. 7.

A similar function of applying a steady force can be achieved through the air blast **240*a* of FIG. 14. There, force exerters 240, 240*a* both provide a generally linear path for the web when it encounters the cutoff mechanism of rollers 36, 37 en route to the first mandrel 29. After severance, this force continues to be applied to direct the free end portion into the nip between the enveloping roller 28 and the second mandrel 30. Thereafter, the enveloping roller moves in the opposite direction around the second mandrel to return the path to the generally linear configuration of FIG. 3**.

Mandrel Variations

Figure 13:
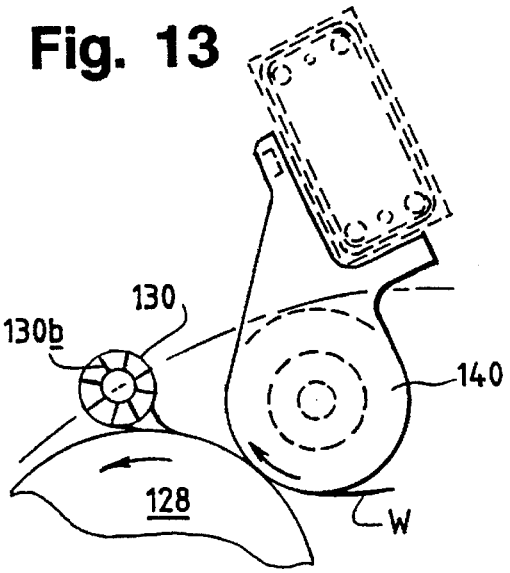
FIG. 13 is a fragmentary side elevational view of a mandrel and enveloping roller in the process of web transfer.

In FIG. 13 the vacuum ports **130*b* are provided in the mandrel 130 which has a smooth, teflon-coated surface. The ports aid in directing the web material into the nip of the winding mandrel 130 and the enveloping roll 128**. In other words, the mandrel vacuum is effective to pull the web material into the nip illustrated. The vacuum keeps the transfer uniform and reduces wrinkling of the web which can cause high tension points. Advantageously, the ports may have countersunk openings facing the web W so as to improve holding strength and permit a lower vacuum.

Should the diameter of the mandrel become too small to permit vacuum, an alternate method would be the use of splines, or flutes 30*a* along the mandrel. The splines aid in pulling the web into the nip and eliminate slippage between the web and mandrel. The splines also improve removal of the finished wound roll from the mandrel as a result of the reduced contact area of the web.

As an example of the practice of the invention utilizing full diameter rollers but with narrow width (600 mm, 24 inches), a mandrel with flutes and vacuum permits web speeds up to about 2500 feet per minute (770 meters per minute).

In FIG. 14, the provision of an air blast means 240*a* on the member 240*b* supports the transfer roller 240 and provides an advantageous function in directing the web material W into the nip of the winding mandrel 230 and the enveloping roll 228. The air blast means is of advantage when the mandrel 230 has such a small diameter that it cannot accommodate vacuum ports. Also, in this case it is of advantage to use the backing roll 38. In such an instance, the rewinder can achieve speeds up to about 1800 fpm (550 rpm). This is about 25% higher than the speed obtainable using a fluted mandrel without vacuum. And with a smooth-surfaced mandrel, the vacuum is most helpful to insure that the mandrel "grabs" the web so as to develop higher speeds.

An advantage stemming from the practice of the invention is the ability to compensate under various tension conditions. This is achieved by varying the speed of the enveloping roller 28, 128 and the speed of the mandrel. This compensates for a change in the length of the web path resulting from moving the enveloping roller.

Structural Features

Figure 15:
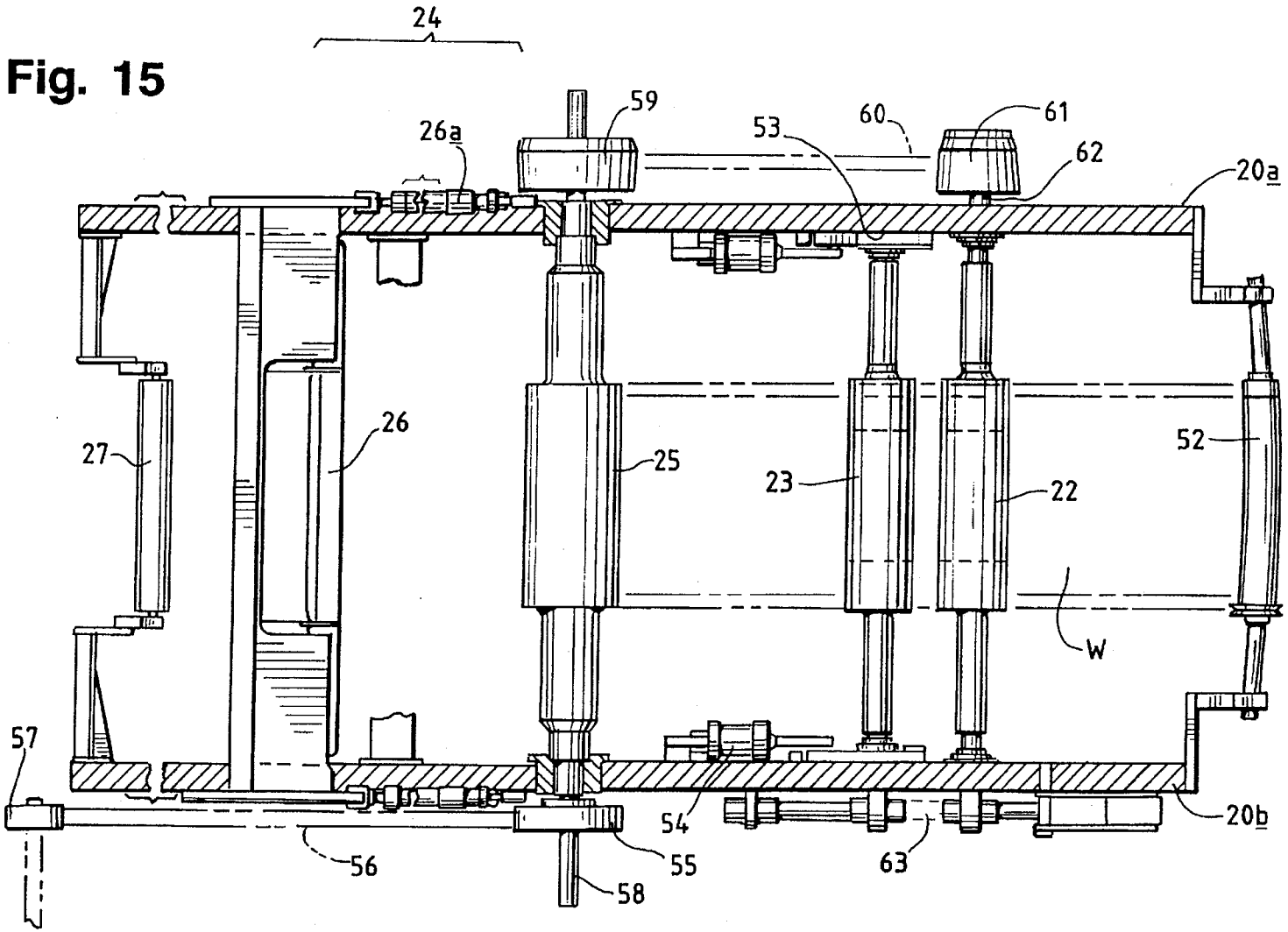
FIG. 15 is a developed plan view of some of the various elements of the inventive apparatus such as would generally be seen along the sight line 15—15 as applied to FIG. 2.
Figure 16:
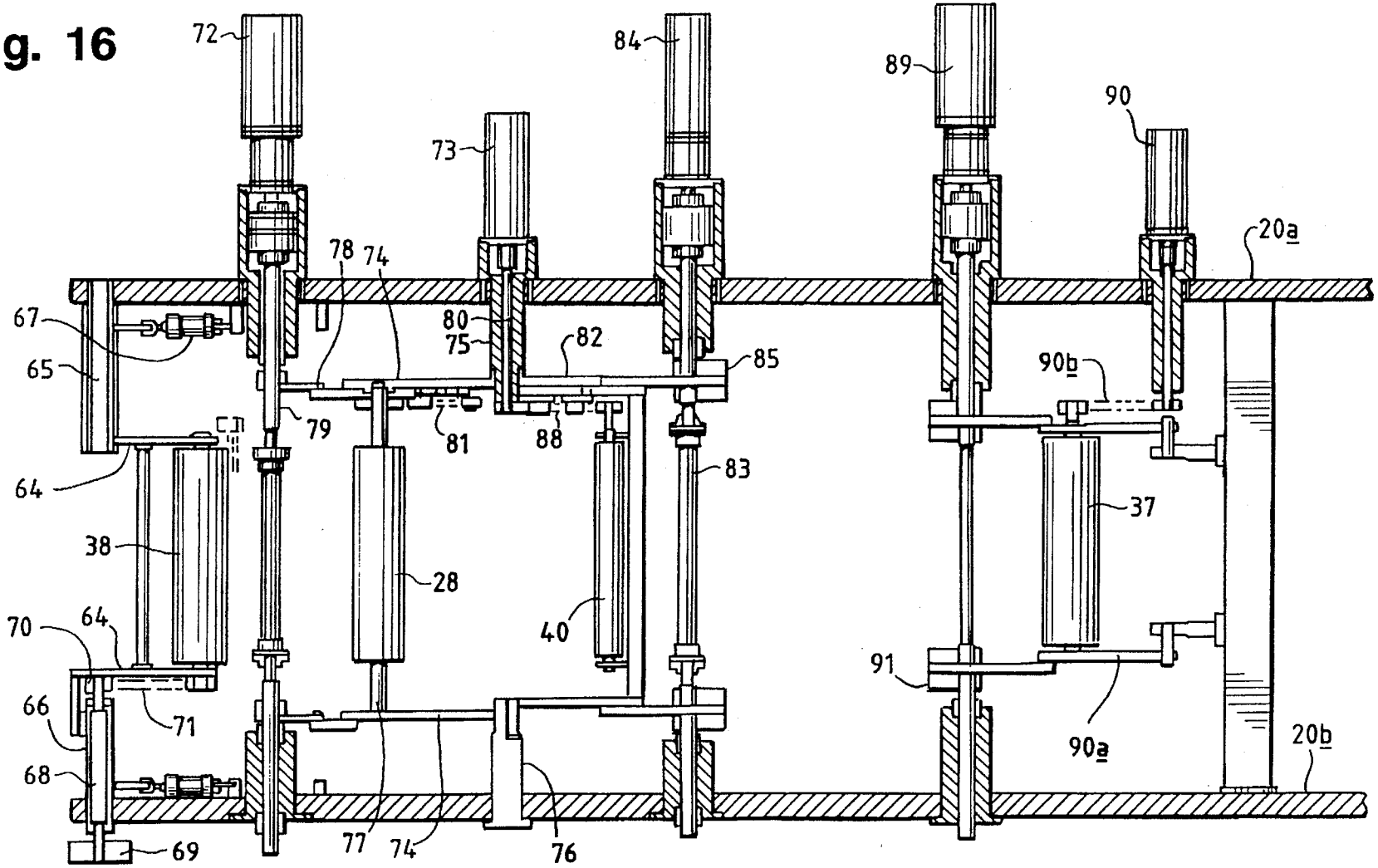
FIGS. 16 and 17 are further developed plan views as would generally be seen along the sight lines 16—16 and 17—17, respectively, as applied to FIG. 2.
Figure 17:
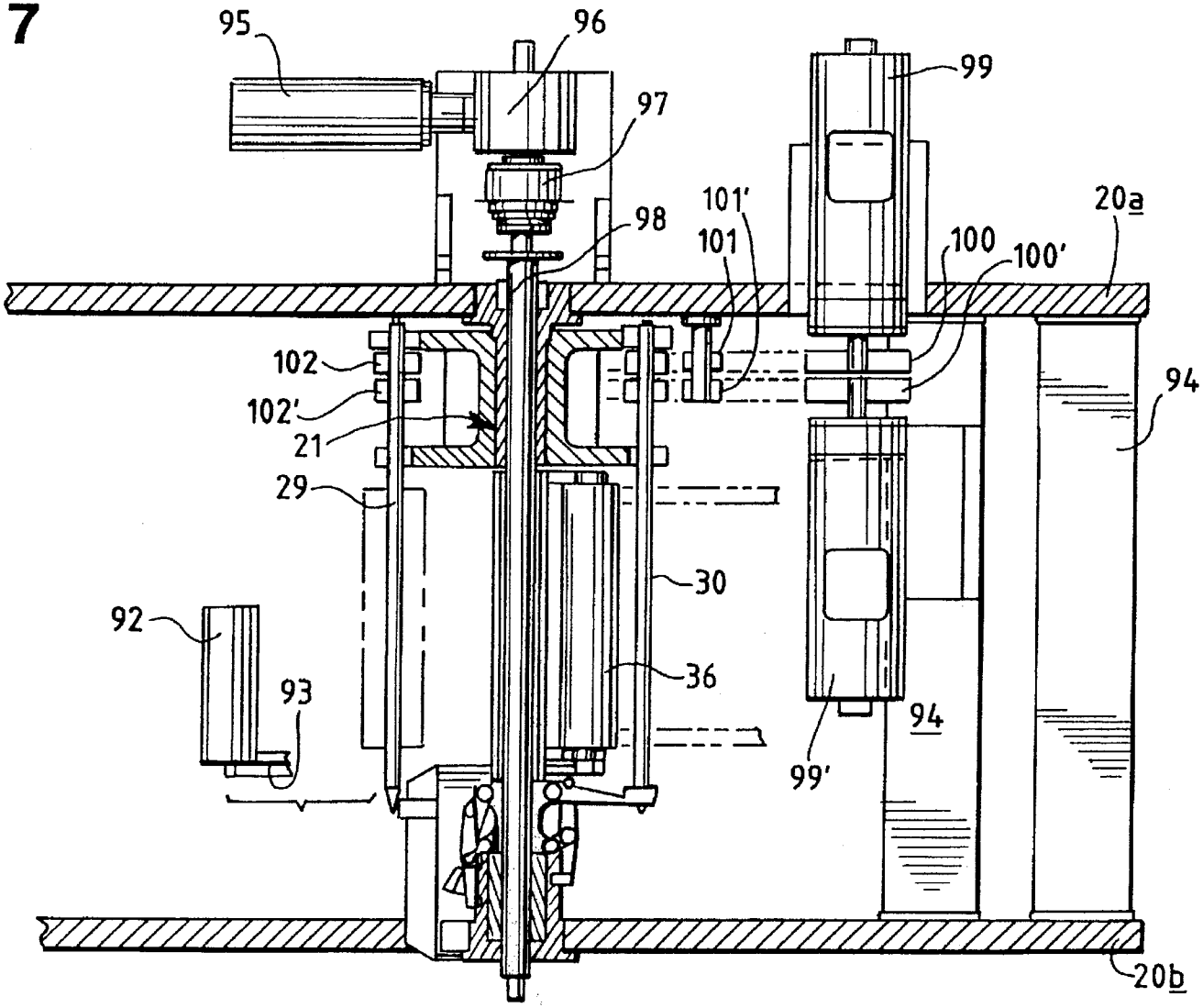

Reference is now made to FIGS. 15–17 which are developed or "expanded" plan views of the various elements employed in the practice of the invention for winding a convolutely wound coreless roll. In FIG. 15, the numerals 20*a* and 20*b* designate side frames (see the right side of FIG. 15). The frame defines a generally longitudinally extending path P for web travel—see FIG. 2.

FIG. 15

Starting at the right of FIG. 15, there is first a spreader roller 52 which removes wrinkles before the web W is drawn along the path P by draw rollers 22, 23. In the illustration given, the roller 22 is fixed while the roller 23 is pivotably mounted. The numeral 53 designates the two pivot arms and the numeral 54 designates the loading cylinders for the draw roller 23. The draw rollers are driven—from the perforator roll 25. So, before going into the drive, we first discuss the perforator in connection with FIG. 15.

Perforator

The first operation performed on the web normally is cross perforation as by the perforator 24 which as previously described includes at least one rotating roller 25 operated by a drive pulley 55. The engagement of the web with the perforator 25 results in providing the web with equally longitudinally spaced lines of transverse perforation. The knife bar 26 is equipped with lift cylinders 26*a*.

Drive

The timing belt pulley 55 is coupled by a cog belt 56 (see the lower left portion of FIG. 15) to the rewinder main drive input pulley 57.

As illustrated, one end of the perforator roller shaft 58 is equipped with pulley 55 while the other end has a pulley 59. This is connected via belt 60 to a variable speed drive 61 which, in turn, is connected to the shaft 62 of the fixed draw roll 22. A timing belt drive 63 connects the draw roll 22 with the draw roll 23. Last in proceeding to the left in FIG. 15 is the idler roller 27. We now go to FIG. 16.

FIG. 16

At the extreme left in FIG. 16 is the backing roller 38 which, when used, is pivotally, rotatably mounted on the frame members 20*a*, 20*b* for pressing the web W onto the various mandrels. The backing roller 38 is rotatably mounted on pivot arms 64 which are fixed to pivot tubes 65, 66 rotatably carried by the side frames 20*a*, 20*b*. A pair of pivot cylinders 67 are coupled between each of the side frames 20*a*, 20*b* and the tubes 65 for pivoting the backing roller 38 as previously described—see FIGS. 3–4.

Rotatably mounted in the tube 66—the lower one as illustrated—is a drive shaft 68. The shaft 68 protrudes at both ends of the tube 66 and, at one end, is equipped with a pulley 69 coupled to the perforator roller 25. At the other end, the shaft 68 has a pulley 70 which rotates the backing roller 38 via a belt and pulley 71.

Enveloping Roller

The next roller in proceeding to the right in FIG. 16 is the enveloping roller 28 which is pivotally, rotatably mounted on the side frames 20*a*, 20*b*. Two servo motors are provided for this dual movement. A servo motor 72 controls the pivotal position of the enveloping roller 28 while servo motor 73 controls the speed of the enveloping roller 28.

For pivoting the enveloping roller 28, a pair of pivot arms 74 are journaled at one end on members 75, 76. Adjacent their other ends, the arms 74 rotatably carry the shaft 77 of the enveloping roller 28. At the ends near the connection of the shaft 77, the arms 74 are coupled to a pivot linkage 78 fixed to a transverse shaft 79 driven by the servo motor 72. This provides for pivoting the enveloping roller 28 from a first position (FIG. 3) where the web is out of contact with the backing roller 38 to a second position (FIG. 6) where the web W is wrapped about both the enveloping roller, the mandrel 22 and in contact with the backing roller 38.

For rotating the enveloping roller 28, the servo motor 73 is equipped with an output shaft 80 which extends through the member 75. The inner end of shaft 80 is coupled by a belt drive 81 to the shaft 77 of the enveloping roller 28.

Transfer Roller

Next to the right in FIG. 16 is the transfer roller 40 which again is rotatably, pivotally mounted on the side frames 20*a*, 20*b*—in a fashion analogous to that of the enveloping roller 28.

For pivotal movement, a pair of pivot arms 82 are provided which rotatably carry the transfer roller 40. These are coupled to the output shaft 83 of the servo motor 84 via crank arms 85 which serves to position the transfer roller 40.

It will be appreciated that the pivotal movement of the transfer roller 40 is through an angle as can be appreciated from the arc designated 86 in FIG. 7. In like fashion, the arc through which the enveloping roller 28 moves is substantially greater as can be appreciated from the arc 87 of FIGS. 3 and 6.

For rotating the transfer roller 40, a belt drive 88 is provided which connects the servo motor 73 to the transfer roller 40.

Cutoff Roller

Approaching the right in FIG. 12, the cutoff roller 37 is seen. This again is both rotatably and pivotally mounted on the side frames 20*a*, 20*b* by means again similar to those mounting the enveloping roller 28. More particularly, the pivot motion is brought about by servo motor 89 and the rotation by servo motor 90. Pivot arms for rotatably carrying the cutoff roller 37 are seen at 90*a* and a drive at 91*b*. A crank arm 91—like the crank arm 85 allows the servo motor 90 in this case, to make a full revolution without backing up. Thus, the cutoff roll 37 pivots down through arc 51—see FIG. 6 and returns via the crank motion.

FIG. 17

At the center of FIG. 17 is the brush anvil roller 36 which cooperates with the cutoff roller 37 as illustrated in FIG. 8. The anvil roller 36 is rotatably mounted between the side frames 20*a*, 20*b* and rotated by means of motor 92 through a pulley and belt drive 93—see also FIG. 2.

Turret and Mandrels

Also seen in FIG. 17 is the turret 21 and the mandrels 29, 30. The turret 21 is rotatably mounted in the side frames 20*a*, 20*b*. These side frames are interconnected by spacers as at 94—see the right side of FIG. 17.

The output of the motor 95 is delivered to a right angle gear box 96 and a clutch 97. The output of clutch 97 is a shaft 98 which is keyed or otherwise fixed to the spider-like turret 21.

A pair of motors 99, 99' are provided for driving the mandrels. In the illustration given, the motor 99 drives the even numbered mandrels, viz., 30 and 32 of FIG. 2 while the motor 99' drives the odd numbered mandrels 29, 31. The mandrel drives are similar to those described in U.S. Pat. No. 3,697,010. Each motor output shaft is connected to a drive as at 100, 100'. that are entrained over idlers 101, 101' and then over mandrel pulleys 102, 102'. Depending upon whether the mandrel is even or odd, one pulley 102, 102' is keyed to a first mandrel while the other 102', 102 is rotatably mounted on the second mandrel in question. A detailed explanation of this is set forth in co-owned U.S. Pat. No. 3,116,890.

Controller

The numeral 103 in FIG. 1 designates a controller which controls the operation of the various rollers and, especially the pivoting and rotation thereof, i.e., the various motors described in conjunction with FIGS. 15–17. For example, the speed of the enveloping roller 38 along with the mandrel speed is controlled to compensate for the changing web length from the perforator to the log being wound when the enveloping roll 28 and turret 21 change position—compare FIGS. 3 through 6. More particularly, as the web path changes by the change of the enveloping roller position, the roller downstream speed up or slow down to correct for the change without changing tension. Some tension change could be permitted depending on the percent of stretch available in the web material. It is advantageous to change the enveloping roller rotational position (speed) along with all rollers and mandrels downstream to compensate for the web length change. This would include the enveloping roller, the mandrel winding the present product, the new mandrel being enveloped by the web, the backing roller, the transfer roller, the cutoff roller, and the brush roller.

The position of the enveloping roller is programmed as a function of the product. The program calculates the change in web length as a result of the changed enveloping roller position, and changes the programmed speed of the downstream rollers/mandrels accordingly. A suitable controller for the inventive rewinder is Model PIC 900 obtainable from Giddings and Lewis located in Fon-du-Lac, Wis.

Summary of Operation

The inventive method includes the following steps to form a coreless, convolutely wound roll of bathroom tissue, kitchen toweling or the like from an elongate web having equally longitudinally spaced transverse lines of perforation:

a. providing an enveloping roller 28, first and second mandrels 29, 30 and a transfer roller 40 in the path P of travel of a web W to be wound, b. advancing the web W in partial enveloping relation with the enveloping roller 28 and toward the first mandrel 29, c. moving the second mandrel 30 to a position adjacent the web W, d. moving the enveloping roller 28 and web directing means (such as the transfer roller 40) to positions defining a pocket (see FIG. 8) with the second mandrel 29 in the pocket and to define a nip 50 between the second mandrel 30 and the enveloping roller 28, e. rotating the transfer roller 40 in a direction 41 opposite to the direction 42 of advance of the web (compare FIGS. 7 and 9), f. severing the web to provide a leading edge portion 46, and g. substantially simultaneously with the severing, contacting the transfer roller 40 and the web leading edge portion 46 to drive the leading edge portion against the enveloping roller 28 and also toward and into the nip 50 to wind the web on the second mandrel 30.

More generally, the invention includes both method and apparatus for rewinding an elongate web to form a coreless, convolutely wound roll having equally spaced transverse lines of perforation. This includes a center wind rewinder having a turret equipped with a plurality of orbiting, circumferentially spaced driven mandrels, the winder also having a rotating enveloping roller.

The invention further includes the step of (or means for) advancing the web downstream along a path P having a generally linear configuration between an upstream portion on the enveloping roller 28 and a downstream position on a first mandrel on which the web is being directly wound, rotating the turret to bring a second mandrel adjacent the web, and the enveloping roller in one generally arcuate direction 37 (see FIGS. 3 and 6) partway around the second mandrel to form a generally S-shaped configuration 104 (see FIG. 10) in the web path about the enveloping roller and the second mandrel while the web is being wound on the first mandrel. In this fashion, the web partially wraps the enveloping roller upstream of the second mandrel and with the enveloping roller and second mandrel forming a nip 50. The web downstream of the second mandrel has a generally linear configuration between the second mandrel and the first mandrel.

We then apply a steady force to the web downstream of the second mandrel to deflect the web toward said enveloping roller 28. The web is then in condition for transverse severing along a predetermined line of perforation to provide a free leading edge portion.

The continued application of the force directs the free leading edge portion into the nip 50 to start the wind. Thereafter both rollers 28, 40 are moved to their FIG. 3 position.

While in the foregoing specification a detailed description of the invention has been set down for the purpose of illustration, many variations in the details herein given may be made by those skilled in the art without departing from the spirit and scope of the invention.

We claim:

1. In a method for winding in cycles an elongate web having first and second opposite sides and also having equally longitudinally spaced lines of transverse perforation to form a series of coreless convolutely wound rolls, the steps of perforating said web to provide a series of longitudinally spaced, transversely-extending lines of perforation each having aligned perforations separated by uncut bonds of the order of about ½–1 millimeters between adjacent perforations, providing a center wind rewinder having a turret equipped with a plurality of orbiting, circumferentially spaced rotating mandrels, said rewinder also having a rotating enveloping roller and providing a web path having an upstream end at said enveloping roller and a downstream end at said turret, providing movable steady non-pulsating force applying means and movable web severing means outside the mandrel orbit, advancing said web downstream along said path, said path during a major portion of each winding cycle having a generally linear configuration between an upstream position where said web first side is on said enveloping roller and a downstream position where said web second side is on a first mandrel on which said web is being directly wound, rotating said turret to bring a second mandrel into contact with said web second side in a position between said enveloping roller and said first mandrel to start a portion of each winding, cycle subsequent to said major portion, moving said enveloping roller to contact and move said web during said subsequent portion of each winding cycle in one generally arcuate direction partway around said second mandrel to form a generally S-shaped configuration in said web path about said enveloping roller and said second mandrel while said web is being wound on said first mandrel whereby said web first partially wraps said enveloping roller upstream of said second mandrel and thereafter with said enveloping roller being closely adjacent said second mandrel to form a nip, moving said steady non-pulsating force applying means to apply a steady non-pulsating force to said web downstream of said second mandrel to deflect said web toward said enveloping roller, thereafter moving said web severing means into contact with said web to immediately start transversely severing said web along a predetermined line of perforation in said path between said first and second mandrels to provide a free leading edge portion and an exact count, and continuing the application of said force to direct said free leading edge portion into the said nip between said enveloping roller and said second mandrel.

2. The method of claim 1 in which the second-mentioned providing step includes providing said steady force applying means separate from said web severing means.

3. The method of claim 1 in which said steps include providing an air blast adjacent said web path to provide said force to deflect said web and to direct said web into said nip.

4. The method of claim 1 in which said steps include controlling the rotational speed of said enveloping roller to compensate for changes in path length.

5. The method of claim 1 in which said steps include providing vacuum ports along the length of each mandrel and applying vacuum to said ports at least at the beginning of winding a web roll.

6. The method of claim 5 in which said steps include providing each mandrel with a smooth outer surface.

7. The method of claim 1 in which said steps include providing each said mandrel with a plurality of flutes at least over part of the axial length thereof.

8. The method of claim 1 in which said providing a rewinder step includes providing a perforator in said web path upstream of said enveloping roller to develop said longitudinally spaced lines of perforation in said web.

9. The method of claim 8 in which said steps include varying the longitudinal spacing between adjacent lines of perforation.

10. The method of claim 1 in which said severing step includes providing a rotating cutoff roller and an anvil roller in said path and changing the rotational speed of said cutoff roller to change the length of web being wound on said second mandrel.

11. The method of claim 10 in which said providing a rewinder step includes providing a perforator in said path to develop said plurality of equally longitudinally spaced perforations in said web and changing the speed of said cutoff roller relative to the speed of said web.

12. The method of claim 10 in which said steps include positioning said cutoff roller away from said anvil roller except during said severing step.

13. The method of claim 1 in which said steps include pressing said free leading edge portion against a portion of said web rearward of said leading edge portion to laminate the two together.

14. In a method for winding in cycles an elongate web along an elongated path of travel to cyclically form a series of coreless, convolutely wound rolls from said web, said web having equally longitudinally spaced transverse lines of perforation, said web having first and second sides, the steps of providing a rotating enveloping roller in contact with said web first side, also providing first and second rotating mandrels adapted to contact said web second side and a rotating transfer roller in the path of travel of said web, said web having an upstream end at said enveloping roller and a downstream end at said first mandrel, said transfer roller having a surface portion adapted to contact said first side of said web when said web is advancing in said path and upstream of said first mandrel, said second mandrel also being in contact with said web when said transfer roller contacts said web and said second roller then being upstream of said transfer roller, advancing a web in partial enveloping relation with said enveloping roller and winding said web on said first mandrel, moving said second mandrel to a position adjacent said path, moving said enveloping roller and transfer roller to positions adjacent each other with said second mandrel being adjacent both said rollers and defining a nip with said enveloping roller, rotating said transfer roller surface portion in a direction opposite to the direction of advance of said web in said path while moving said transfer roller to apply a steady force to web to deflect said web toward said enveloping roller, thereafter, severing said web between said first and second mandrels and along a predetermined line of perforation to provide a free leading edge portion, and continuing the application of said force by said transfer roller to press said leading edge portion against said enveloping roller and toward and into said nip to wind said web on said second mandrel.

15. The method of claim 14 in which said steps include controlling the rotational speed of said enveloping roller and the rotational speed of said first mandrel to compensate for a change in the length of said web path resulting from moving said enveloping roller.

16. The method of claim 14 in which said steps include providing vacuum ports along the length of each mandrel and applying vacuum to said ports at least at the beginning of winding a web roll.

17. The method of claim 16 in which said steps include providing each mandrel with a smooth outer surface.

18. The method of claim 14 in which said steps include providing each said mandrel with a plurality of flutes at least over part of the axial length thereof.

19. The method of claim 18 in which said steps include providing air jet means for directing said free end portion into said nip.

20. Apparatus for winding in cycles an elongate web having first and second opposite sides and also having equally longitudinally spaced transverse lines of perforation to form a series of coreless convolutely wound rolls, comprising a frame equipped with a perforator and defining a path of web travel and having a turret equipped with a plurality of orbiting, circumferentially spaced rotating mandrels, said frame also having a rotating enveloping roller, said web path having an upstream end at said enveloping roller and a downstream end at said turret, said perforator having blades to provide bonds between perforations of the order of ½–1 millimeters, a movable steady non-pulsating force applying means and movable web severing means mounted on said frame outside the mandrel orbit, means operably associated with said frame for advancing said web downstream along said path, said path during a major portion of each winding cycle having a generally linear configuration between an upstream position where said web first side is on said enveloping roller and a downstream position where said web second side is on a first mandrel on which said web is being directly wound, means on said frame for rotating said turret to bring a second mandrel into contact with said web second side in a position between said enveloping roller and said first mandrel to start a portion of each winding cycle subsequent to said major portion, means on said frame for moving said enveloping roller and said web during said subsequent portion of each winding cycle in one generally arcuate direction partway around said second mandrel to form a generally S-shaped configuration in said web path about said enveloping roller and said second mandrel while said web is being wound on said first mandrel whereby said web first partially wraps said enveloping roller upstream of said second mandrel and with said enveloping roller thereafter being closely adjacent said second mandrel to form a nip, means on said frame for moving said steady force applying means to apply a steady transverse force to said web downstream of said second mandrel to deflect said web toward said enveloping roller, means on said frame for moving said web severing means into contact with said web to immediately start transversely severing said web along a predetermined line of perforation in said path between said first and second mandrels to provide a free leading edge portion, and said applying means continuing the application of said force to direct said free leading edge portion into said nip between said enveloping roller and said second mandrel.

21. The apparatus of claim 20 in which said means for moving said steady force applying means are mounted on first arm means and said means for moving said web severing means are mounted on second arm means separate from said first arm means.

22. The apparatus of claim 20 in which means are operably associated with said frame for controlling the rotational speed and position of said enveloping roller.

23. The apparatus of claim 22 in which said controlling means is operative to alter the rotational speed of said enveloping roller to compensate for a change in the length of web path resulting from orienting said enveloping roller.

24. The apparatus of claim 20 in which said severing means includes a rotating anvil roller rotatably mounted on said frame for contacting said web in said path, a cutoff roller rotatably mounted on said frame for coaction with said anvil roller and means operably associated with said frame for pivoting said cutoff roller into contacting relation with said web in said path, means operably associated with said frame for changing the rotational speed of said cutoff roller to change the length of web being wound on said second mandrel.

25. The apparatus of claim 24 in which said perforating means are mounted on said frame for engaging said web in said path for developing a plurality of equally longitudinally spaced perforations in said web, said speed changing means being operative to changing the speed of said cutoff roller relative to the speed of said web.

26. The apparatus of claim 24 in which said frame is equipped with means for positioning said cutoff roller away from said anvil roller except at transfer.

27. The apparatus of claim 20 in which means are provided in said frame for intermittently applying a bonding agent to said web.

28. The apparatus of claim 20 in which said mandrels include vacuum ports along the length of each mandrel and means for applying vacuum to said ports at least at the beginning of winding a web roll.

29. The apparatus of claim 28 in which each mandrel is equipped with a smooth outer surface.

30. The apparatus of claim 20 in which each mandrel is equipped with a plurality of flutes at least over part of the axial length thereof.

31. The apparatus of claim 30 in which said frame includes air jet means for directing said free end portion.

32. Apparatus for winding in cycles an elongate web having first and second sides and also having equally longitudinally spaced transverse lines of perforation to form a series of coreless, convolutely would rolls, comprising a frame defining a path of web travel, an enveloping roller, first and second mandrels and a transfer roller all rotatably mounted on said frame in said path, said transfer roller having a surface portion adapted to contact a web advancing in said path, said path having an upstream end at said enveloping roller and a downstream end at said first mandrel, means on said frame for advancing said web in partial enveloping relation with said enveloping roller and onto said first mandrel, said path during a major portion of each winding cycle having a generally linear configuration between an upstream position where said web first side is on said enveloping roller and a downstream position where said web second side is on said first mandrel, turret means rotatably mounted on said frame for moving said second mandrel to a position adjacent said path while moving said first mandrel toward a roll stripping position, said second mandrel in said position adjacent said path being in contact with said web second side and being located between said enveloping roller and said first mandrel to start a portion of each winding cycle subsequent to said major portion, means on said frame for moving said enveloping roller and said web during said subsequent portion of each winding cycle in one generally arcuate direction partway around said second mandrel to form a generally S-shaped configuration in said web path about said enveloping roller and said second mandrel while said web is being wound on said first mandrel whereby said web partially wraps said enveloping roller upstream of said second mandrel and with said enveloping roller being closely adjacent to said second mandrel to define a nip between said second mandrel and said enveloping roller, said web downstream of said second mandrel having a generally linear configuration between said second mandrel and said first mandrel, means on said frame for rotating said transfer roller surface portion in a direction opposite to the direction of advance of said web, means on said frame for severing said web along a predetermined line of perforation in said path between said first and second mandrels to provide a leading edge portion, and means on said frame for substantially simultaneously with said severing, contacting said transfer roller with said web leading edge portion to press said leading edge portion against said enveloping roller and toward and into said nip to wind said web on said second mandrel.

33. The apparatus of claim 32 in which said frame is equipped with a backing roll.

34. In a method for winding in cycles an elongate web having first and second opposite sides and also having equally longitudinally spaced lines of transverse perforation to form a series of coreless convolutely wound rolls, the steps of providing a center wind rewinder having a turret equipped with a plurality of orbiting, circumferentially spaced rotating mandrels, said rewinder also having a rotating enveloping roller and providing a web path having an upstream end at said enveloping roller and a downstream end at said turret, providing a transfer roller adjacent said web path, advancing said web downstream along said path, said path during a major portion of each winding cycle having a generally linear configuration between an upstream position where said web first side is on said enveloping roller and a downstream position where said web second side is on a first mandrel on which said web is being directly wound, rotating said turret to bring a second mandrel into contact with said web second side in a position between said enveloping roller and said first mandrel to start a portion of each winding cycle subsequent to said major portion, moving said enveloping roller to contact and move said web during said subsequent portion of each winding cycle in one generally arcuate direction partway around said second mandrel to form a generally S-shaped configuration in said web path about said enveloping roller and said second mandrel while said web is being wound on said first mandrel whereby said web first partially wraps said enveloping roller upstream of said second mandrel and thereafter with said enveloping roller being closely adjacent said second mandrel to form a nip, applying steady force to said web downstream of said second mandrel to deflect said web toward said enveloping roller, thereafter transversely severing said web along a predetermined line of perforation in said path between said first and second mandrels to provide a free leading edge portion, and continuing the application of said force to direct said free leading edge portion into the said nip between said enveloping roller and said second mandrel, said transfer roller having a surface portion adapted to contact said first side of said web and downstream of the contact of said second web with said mandrel while said web is advancing in said path, and rotating said transfer roller surface portion in a direction opposite to the direction of advance of said web to provide in combination with said enveloping roller said force to deflect said web and to direct said web free leading edge portion into said nip.

35. Apparatus for winding in cycles an elongate web having first and second sides and also having equally longitudinally spaced transverse lines of perforation to form a series of coreless, convolutely wound rolls, comprising a frame defining a path of web travel and having a turret equipped with a plurality of orbiting, circumferentially spaced rotating mandrels, said frame also having a rotating enveloping roller, said web path having an upstream end at said enveloping roller and a downstream end at said turret, means operably associated with said frame for advancing said web downstream along said path, said path during a major portion of each winding cycle having a generally linear configuration between an upstream position where said web first side is on said enveloping roller and a downstream position where said web second side is on a first mandrel on which said web is being directly wound, means on said frame for rotating said turret to bring a second mandrel into contact with said web second side in a position between said enveloping roller and said first mandrel to start a portion of each winding cycle subsequent to said major portion, means on said frame for moving said enveloping roller and said web during said subsequent portion of each winding cycle in one generally arcuate direction partway around said second mandrel to form a generally S-shaped configuration in said web path about said enveloping roller and said second mandrel while said web is being wound on said first mandrel whereby said web first partially wraps said enveloping roller upstream of said second mandrel and with said enveloping roller thereafter being closely adjacent said second mandrel to form a nip, means on said frame for applying a steady transverse force to said web downstream of said second mandrel to deflect said web toward said enveloping roller, means on said frame for transversely severing said web along a predetermined line of perforation in said path between said first and second mandrels to provide a free leading edge portion, said applying means continuing the application of said force to direct said free leading edge portion into said nip between said enveloping roller and said second mandrel, and said frame including a transfer roller adjacent said web path, said transfer roller having a surface portion adapted to contact a web advancing in said path, and means for rotating said transfer roller surface portion in a direction opposite to the direction of advance of said web to apply said force to direct said web free leading edge portion into said nip.

* * * * *